US005159884A

United States Patent [19]

Malick

[11] Patent Number: 5,159,884

[45] Date of Patent: Nov. 3, 1992

[54] AUTOMATIC INCINERATOR APPARATUS

[76] Inventor: Franklin S. Malick, 518 Greenleaf Dr., Monroeville, Pa. 15146

[21] Appl. No.: 760,995

[22] Filed: Sep. 17, 1991

Related U.S. Application Data

[63] Continuation-in-part of Ser. No. 546,925, Jul. 2, 1990, abandoned.

[51] Int. Cl.[5] ..... F23G 5/02

[52] U.S. Cl. ..... 110/223; 110/235; 110/243; 110/259; 110/165 R

[58] Field of Search ..... 110/243, 244, 245, 223, 110/165 R, 256–259

[56] References Cited

U.S. PATENT DOCUMENTS

| | | | |
|---|---|---|---|
| 2,524,868 | 10/1950 | Worsham | 110/259 |
| 3,592,151 | 7/1971 | Webber | 110/243 |
| 3,858,534 | 1/1975 | Berg | 110/243 |
| 4,622,903 | 11/1986 | Warren et al. | 110/165 R |
| 4,706,560 | 11/1987 | Capodicasa | 110/223 |
| 4,747,355 | 5/1988 | Van Berkum | 110/257 |
| 4,785,744 | 11/1988 | Fontaine | 110/235 |

*Primary Examiner*—Henry C. Yuen
*Attorney, Agent, or Firm*—Clifford A. Poff

[57] ABSTRACT

A ram feed waste incinerator apparatus includes a vertical waste storage cylinder positioned above a combustion chamber and contains a movable ram to force the waste to be incinerated downwardly against a transversely extending, rotatably driven bar at the top of the combustion chamber. Combustion temperature control is provided by feeding air into the combustion chamber and by rotating the bar to abrade char from the waste supported by the bar. A bed of ash is maintained within optimum levels for thermal protection of bottom of the combustion chamber.

28 Claims, 9 Drawing Sheets

AUTOMATIC INCINERATOR APPARATUS

CROSS REFERENCE TO RELATED

This application is a continuation-in-part of U.S. patent application Ser. No. 07/546,925, Filed Jul. 2, 1990, now abandoned.

BACKGROUND OF THE INVENTION

1. Field of the Invention

The present invention relates generally to waste disposal apparatus, and more particularly, to incinerator apparatus for burning waste. Still more particularly, the present invention is directed toward a "ram" incinerator apparatus having beneficial application in the home or small business/commercial establishment for burning garbage, paper, clothing, and the like.

2. Description of the Prior Art

Incinerator apparatus of various constructions are known in the prior art. One particular class of incinerator apparatus into which the present invention can be broadly categorized may be described, for purposes of discussion only, as a "ram" incinerator. Such "ram" incinerators generally include a vertical waste storage cylinder positioned above a combustion chamber such that, during operation, a ram-like means forces the waste to be incinerated downwardly in the direction of the combustion chamber with the waste itself forming the top of the combustion chamber. At the completion of the advancement of the ram, most of the waste originally contained in the waste storage cylinder is incinerated leaving a residual plug of char in the storage cylinder which is used for the starting of the next burn. In the design of such "ram" incinerators a number of different methods have been proposed for preventing the load of waste from falling or collapsing into combustion chamber during incineration of the waste. For example, U.S. Pat. Nos. 3,313,253 and 3,357,376 have used stationary transversely disposed electrical resistance heating rods acting as a grate-like support for the waste. U.S. Pat. Nos. 3,295,477; 3,336,884 and 3,357,379, have used a conical restriction at the bottom of the vertical waste storage cylinder as a means for utilizing the inherent structural strength and coherence of the charred waste material at the bottom of the load of waste in order to bridge the space above the combustion chamber. Attempts have been made to use a continuously rotating vertical post positioned within the combustion chamber and having a cap thereatop for supporting the bottom of the load of waste and for scraping charred material from the bottom of the waste.

Each of these methods, was deficient. For example, in designs which used stationary transversely disposed electrical heating rods as a grate-like support for the waste, the stationary rods have tended to retain rather than pass the burned waste ash so that air could not reach the unburned carbon material above the ash. Consequently, the temperature and combustion rate of such incinerators quickly dropped to inoperable levels soon after the commencement of incineration. In designs which used a conical restriction at the bottom of the vertical waste storage cylinder, the charred bottom of the waste was not a reliable bridge over the combustion chamber and unburned waste clogged the combustion chamber. In designs involving the use of a rotating vertical support/scraper post, the rotating post scraped away more char than was necessary and the excess char evidenced itself as unburned carbon in the waste ash.

All of the aforementioned designs suffered from a common yet vital shortcoming in that none properly controlled the flow of combustible waste into the combustion chamber at the rate required to maintain a constant and optimum combustion rate and temperature.

It has also been proposed in the aforementioned U.S. Pat. No. 3,357,379 to achieve the optimum combustion rate and temperature in such ram incinerators by "air switching" which varied the air turbulence of the combustion air at the waste burning surface. However, this method eventually fails when a layer of dense waste ash such as magazine ash prevents the incoming combustion air from reaching the carbon material above the burning surface. U.S. Pat. No. 3,295,477 proposed to blast the dense waste ash from the burning surface with periodically activated compressed air jets, however this method also blasts off charred but incompletely burned material to become unconsumed carbon in the ash disposal system.

Moreover, there was a time at which ashes were required to be removed from the combustion chambers of the incinerator apparatus disclosed in U.S. Pat. Nos. 3,313,253; 3,357,376 and 3,357,379, otherwise the combustion chambers would become clogged with ashes. U.S Pat. Nos. 3,295,477 and 3,336,884 proposed to rid the combustion chamber of ash by blasting the ash out the bottom of a funnel shaped combustion chamber and into the cooling air stream with compressed air jets. This method of ash removal has the disadvantage that the ash suspended in the cooling air stream must be removed with a cyclone separator to reduce particulates in the exhaust to an acceptable level.

An advantage exists, therefore, for a ram incinerator apparatus which completely and automatically controls start-up, burn, shutdown, and ash removal, as well as the flow of combustible waste into the combustion chamber at the rate required to maintain a constant and optimum combustion rate and temperature.

It is therefore an object of the present invention to provide a waste incinerator which fully automatically controls start-up, burn, shutdown, and ash removal, as well as the flow of combustible waste into the combustion chamber at the rate required to maintain a constant and optimum combustion rate and temperature.

It is a further object cf the present invention to provide a waste incinerator in which the ash is handled as a solid during removal in a controlled manner without generating particulates in the exhaust.

It is an another object of the incinerator to package cold ash for dust free removal or to provide for flushing down a drain into the sewer.

It is another object of the present invention to provide a waste incinerator which maintains a sufficiently high temperature e.g., above 1500° F., and sufficient air in the combustion chamber in order to ensure complete combustion of the carbonaceous material in the waste and thereby eliminate smoke and odor in the exhaust gases.

It is a further object of the present invention to provide a waste incinerator apparatus having a large capacity and which is ram fed so that a large quantity of combustible waste can be loaded therein and then subsequently burned over a relatively extended period of time without requiring the attention of an operator.

It is a still further object of the present invention to provide a waste incinerator apparatus having a system for positively and automatically removing the combustion ash so that the ash remains at sufficient thickness to act as thermal insulation for the bottom of the combustion chamber.

It is yet a further object of the present invention to provide a waste incinerator apparatus which produces a relatively low exhaust gas temperature, preferably of less than about 200° F., to permit the incinerator apparatus to have the same exhaust requirements as today's household clothes dryer.

It is a further object of the present invention to provide a waste incinerator apparatus which avoids the use of combustible gas as an ignition heat source or for supplemental heat.

Still other objects and advantages of the present invention will become apparent in light of the attached drawings and written description of the invention presented herebelow.

SUMMARY OF THE INVENTION

According to one aspect of the present invention there is provided a incinerator apparatus wherein a rotatable bar is located between a waste storage chamber and a combustion chamber for feeding charred waste at controlled times from waste stored in the storage chamber to the combustion chamber, the bar embodies a construction and high temperature materials capable of operating under loads imposed by a ram feed for the waste material and at highest temperatures attainable in the combustion chamber.

According to another aspect of the present invention there is provided a waste incinerator in which charred waste is discharged into a high temperature combustion chamber to undergo combustion to reduce the waste to ash, the improvement comprising means for controlling the thickness of a bed of ash to a value sufficient to thermally insulate the bottom of the combustion chamber.

A still further aspect of the present invention provides a incinerator apparatus wherein a side wall of a combustion chamber divides the combustion chamber into an inner chamber and an outer combustion chamber, the outer chamber takes the form of an annular flow space for exhaust gases passing from the inner combustion chamber to the exhaust so that the exhaust gases reside in the annular flow space for a time which is sufficient for complete combustion of any residual pyrolytic gases and carboneous particulates.

In still a further aspect of the present invention there is provided an incinerator embodying a construction, control and relationship of parts for ignition of waste material by the steps of, controllably feeding charred waste to a combustion chamber, controlling the temperature of the combustion chamber for combustion of the waste therein, maintaining the exhaust gases in an annular chamber arranged about the outer periphery wall of the combustion chamber in a high temperature environment to insure combustion of all residual combustible components, to allow the continuous combustion of all waste stored in a storage chamber, and providing a thermal barrier of ash to prevent overheating of the ash level control.

In the preferred form of the present invention there is provided an incinerator apparatus for incinerating waste material, the apparatus comprising of a vertically extending waste storage container having central longitudinal waste feed axis, a combustion chamber situated below the storage container and in communication therewith, means for compacting waste material loaded into the storage container by applying force to the waste material in the direction of the combustion chamber during incineration of the waste material, means for densifying ash and maintaining a predetermined ash thickness layer in the bottom of the combustion chamber, bar means rotatably supported to extend through the combustion chamber substantially transverse to the central longitudinal waste feed axis for supporting a bottom surface of the compacted waste material in the storage chamber and for abrading charred material from the bottom of the waste, means causing abrading of charred material by the bar means for automatically controlling temperature of the combustion chamber relative to predetermined set point temperature, and means for exhausting combustion gases from the combustion chamber.

DESCRIPTION OF THE PREFERRED EMBODIMENTS

Figure 1:
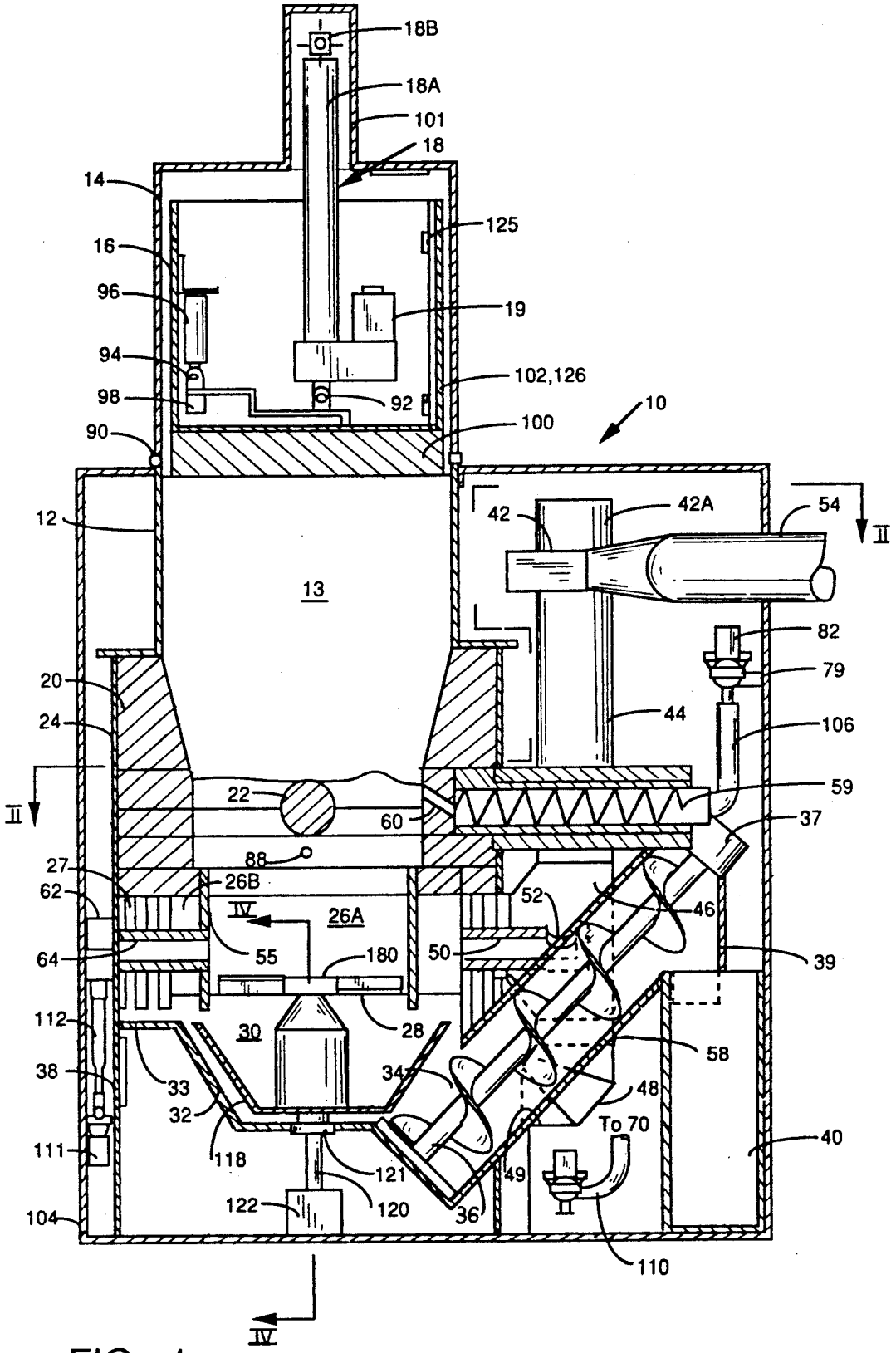
FIG. 1 is an elevation view, in partial section, of the incinerator apparatus of the present invention.

With reference to FIG. 1 there is illustrated a waste incinerator apparatus 10 constructed in accordance with the present invention. The apparatus 10 includes a vertical metal cylinder which forms a waste storage chamber 12 into which a load or "plug" of waste 13 to be incinerated is loaded. A lid 14 covers waste storage chamber 12 and contains a ram 16 which is powered by a motor driven screwjack 18. The ram 14 serves to initially compress the waste 13 and, during the incineration process, force the waste to the bottom of the waste storage chamber 12. Hence, for purposes of discussion only, the incinerator apparatus 10 of the present invention may be figuratively referred to as a "ram" incinerator.

The lower portion, i.e., approximately the bottom six inches, of the waste storage chamber 12 is formed by annular layers of fibrous ceramic insulating material 20 and may, if desired, have a gradually tapering diameter to produce a slight funnel shape. A lower generally cylindrical extension of the fibrous ceramic material 20 is bisected with one or more cylindrical ceramic bars or rods 22 each approximately three inches in diameter and rotatably supported at both ends in teflon sleeve bearings 23 (FIG. 2) mounted in a metal shell 24 which surrounds a combustion chamber 26. One bar 22 is shown for simplicity during operation of the incinerator. the bar 22 driven at one end thereof by a reversible motor 22A (FIG. 2) which, when activated, rotates the bar at about five rpm. Bar 22 serves to prevent the load of waste from falling or collapsing into combustion chamber 26 while, in a manner to be described in greater detail hereinbelow, bar 22 also serves to scrape controlled quantities of charred material from the bottom of the load of waste 13 during the incineration process.

Figure 3:
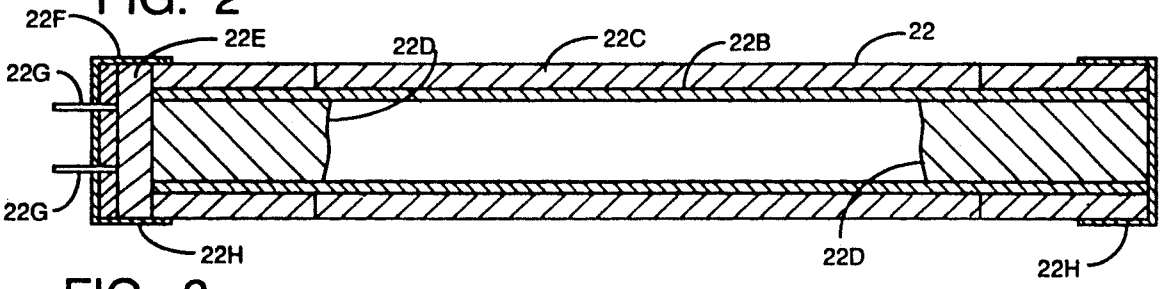
FIG. 3 is a sectional view showing the construction of the rotating grate bar.

In the preferred construction of the rotating bar 22 (FIG. 3) the load bearing core 22B is a Steatite hard ceramic tube with a relatively high thermal conductivity. This core tube is placed inside of and cemented to a ceramic fiber tube 22C with low thermal conductivity to insulate the hot ceramic tube from the teflon sleeve bearings and to shield the thermal shock sensitive hard ceramic core 22B from the high thermal gradients developed during start-up. In the central portion of the bar there is a hollow core closed off by end barriers 22D formed from ceramic fiber. At the driven end of the bar, an end plate 22E is attached to the tube 22. Plate 22E supports a drive plate 22F which is provided with drive pins 22G to receive torque from bar drive motor. Sheet metal end caps 22H are provided in each of opposite ends of the bar. This construction permits usage of the aforementioned relatively inexpensive teflon bearings 23.

The combustion chamber 26 is lined with fibrous ceramic insulating material 27 and the bottom surface of the combustion chamber is formed by the upper surface 28 of the ash 30 from the consumed waste 13. Some distance below the ash surface 28, e.g., two inches, the ash 30 is supported by a metal cone 32 which along with the flat sheet metal annulus 33 which supports the chamber insulation forms an air tight bottom to the combustion chamber. A rectangular opening 34 in the cone permits the ash to pass into a screw conveyor 36 which is driven by motor 37. Cooling air which is later mixed with the exhaust from the outer combustion chamber 26B entering from an inlet 38 provided in shell 24, passes over the exterior of the cone 32 which supports the ash 30 such that the ash is largely cooled by the time that it enters the screw conveyor. The bottom of the ash support cone (FIG. 4) is pierced at its center by a vertical post 120 which passes through an air tight seal 121. This post is rotated continuously at about five revolutions per minute by stirrer motor-gearbox 122. Fastened solidly to the post is a stirrer bar 118 (FIG. 4) which agitates the ash so that it behaves like a liquid and maintains a level surface in combustion chambers 26A and 26B. Also the agitation assure that the ash will flow into the opening 34 and into the screw conveyor 36.

Figure 4:
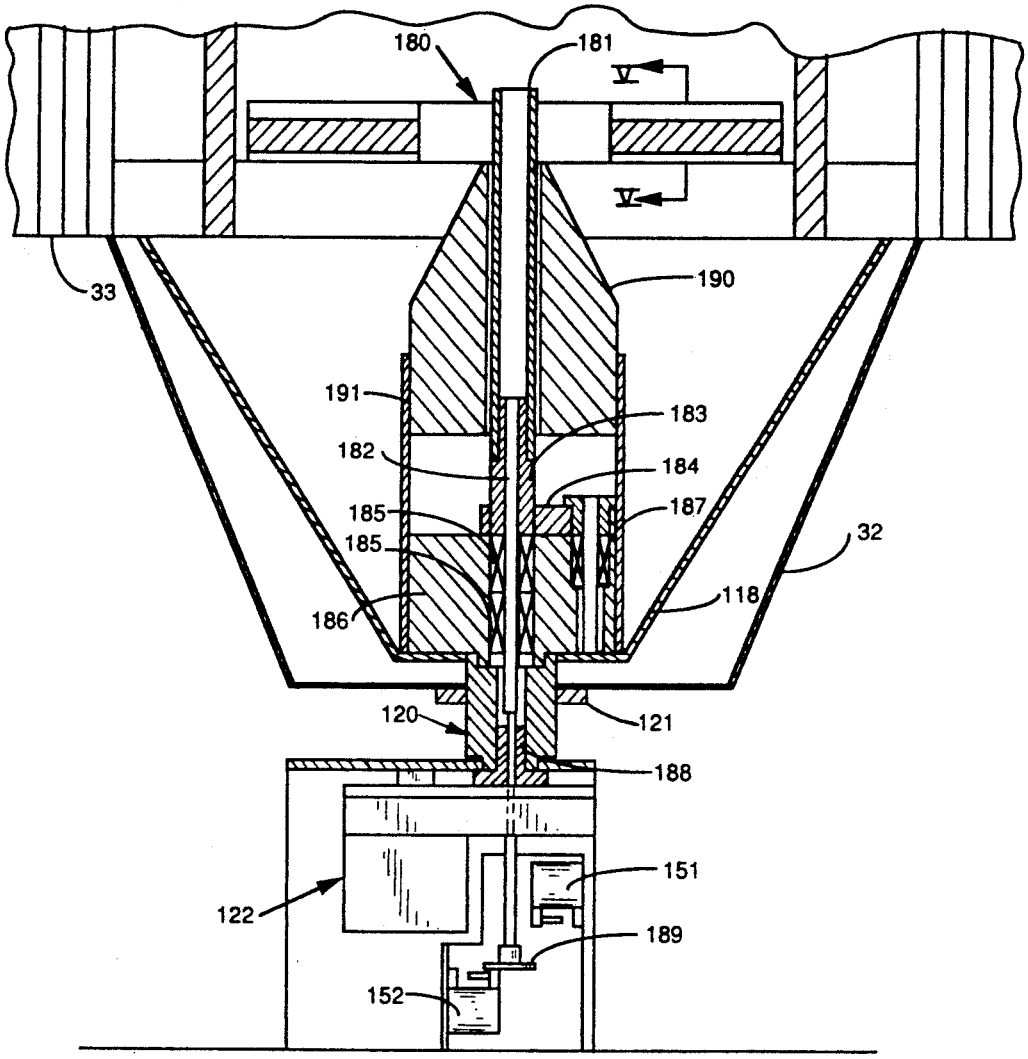
FIG. 4 is an enlarged elevational view in section of the lower portion of the incinerator taken along line IV—IV FIG. 1.
Figure 5:
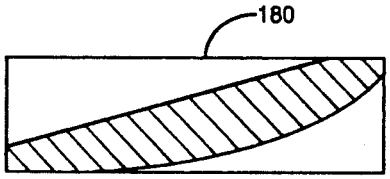
FIG. 5 is a sectional view taken along line V—V of FIG. 4.

Referring to FIG. 4, the post 120 also rotates a ceramic fiber head 180 which is like an airplane propeller with arms extending outwardly from the axis of rotation of post 120. Each arm is shaped with an upturned leading edge, followed by a flat skid so that the arms ride on the top surface of the ash to densify the fluffy new ash and to sense the surface of the densified ash. The upper six inches of post 120 is a Steatite porcelain ceramic tube 181. Tube 181 is connected to stainless steel shaft 182 by a coupling tube 183 which also serves to support a torque arm 184 which causes the stainless steel shaft and the Steatite tube to rotate with the ash stirrer bar 118. The stainless steel shaft is supported by linear ball bearings 185 mounted in an aluminum cylinder 186 which is fastened to the stirrer bar 118 and thereby rotates with it. This cylinder also supports a third linear ball bearing 187 which drives a pin fastened into the torque arm 184. With this construction, post 120 and the ski tip head 180 can rise and fall vertically with the change in the ash level with almost n friction to prevent this vertical movement regardless of the torque required to rotate the ski tip head as it slides on the ash surface. A small diameter extension of the stainless steel shaft 182 extends down through a hole in the gearbox shaft 188. An actuating disc 189 mounted on the lower end of shaft 182 is positioned to actuate an upper limit snap action switch 151 and a lower limit snap action switch 152 for the control of the conveyor motor 37.

A ceramic fiber cone 190 keeps the ash away from the support post 120. Cone 190 rotates with the stirrer bar and is supported by a sheet metal tube 191 which in turn is supported by the aluminum cylinder 186. A clearance is maintained between the ceramic fiber cone and the ceramic tube so that there is no friction to interfere with the vertical movement of post 120. The empty space above the aluminum cylinder 186 and the bottom of the ceramic fiber cone allows the ceramic fiber head and the torque arm to rise about one inch as the ash surface rises. The 60° angle on the cone causes the ash to slide downward as the ash is removed by the screw conveyor. The cone also provides thermal insulation so that the temperature at the linear bearings does not exceed 120° F. even when the ash surface at the rotating ski tip head is 2000° F.

The screw conveyor 36 convey the ash 30 from the cone 32 through chute 39 into a bag 40 for easy removal of the ash from the incinerator. An important feature of the present invention is the removal of ash from the incinerator as a compacted powder. In the past, ash was carried away by the cooling air stream and required a cyclone separator to separate the ash from the carrier air flow. It is contemplated that, as an alternative, the ash which is conveyed by screw conveyor 36 may be fed to a chamber having a drain connected to the building sewage system whereby the ash can be flushed down the drain with water by the actuation of an electrically operated water valve.

A blower 42 driven by a motor 42A, is attached to mixing tube 44. Blower 42 draws air upwardly through the mixing tube 44 which includes a "tee" section 46 and an elbow section 48. The "tee" section 46 makes an air-tight connection with the metal shell 24 while the elbow 48 makes an air-tight entry into the interior of shell 24 at opening 49. Along with other ascribed functions to be disclosed hereinafter, activation of blower 42 causes cold air to be drawn in through inlet 38 such that the cold air can pass over and cool the exterior of the cone 32 whereupon the air then enters the elbow 48 of mixing tube 44 to pass upwardly therethrough and be exhausted from the incinerator apparatus 10.

The "tee" section 46 of the mixing tube 44 contains a horizontal ceramic fiber tube 50 which carries the exhaust from the combustion chamber 26B. A cap 52 on the end of the tube 50 directs the hot exhaust gas from combustion chamber 26 upwardly into mixing tube 44 where the hot exhaust gas mixes with the cold air drawn in by the blower 42 through inlet 38 to reduce the temperature of the combustion chamber exhaust gas to below 200° F. The exhaust from the blower exits the building through a pipe 54 in the same manner in which a household clothes dryer is vented.

The combustion chamber 26 is divided into a cylindrical inner chamber 26A and an annular outer chamber 26B by a stainless steel or ceramic fiber cylinder 55. The bottom of cylinder 55 is open and extends below the ash surface 28 but is spaced from the ash support cone 32 so that the portion of the fly ash which forms the bottom of the annular outer chamber 26B flows downward into the ash support cone 32 for removal by the conveyor 36 along with the ash forming the bottom of the inner chamber 26A.

Hot exhaust gases pass from the outer combustion chamber 26B through an exhaust port 56 formed by an end of exhaust tube 50. The port 56 is preferably about three inches above the minimum level of the ash surface during normal operating conditions of the incinerator apparatus 10. The pressure drop across reduced diameter orifice 58, when the blower 42 is activated, causes the entire interior of incinerator apparatus, including lid 14, to operate below atmospheric pressure. Hence, any opening provided in the metal shell 24 will permit air to enter the combustion chamber 26 and three separate openings are provided for this purpose. The first, or upper, entering point is at the end of an electric air heater 59 which is provided for ignition of the waste 13.

Air heated by electrical resistance the heater 59 enters the combustion chamber 26 at the level of the rotating bar 22 and is directed upwardly by a nozzle or inlet 60 to impinge upon the bottom of the waste material 13 in order to ignite the waste material. A second lower air inlet 62 leads into the inner combustion chamber 26A through a ceramic fiber tube 64 connected thereto. Tube 64 passes through the outer annular chamber 26B, penetrates cylinder 55 and enters inner chamber 26A at a location diametrically opposite the exhaust port 56. A small diameter nozzle hole at the inner end of tube 64 directs high velocity air down onto the surface of the ash to cause high turbulence and rapid combustion of any carbonaceous material resting there. The passage of exhaust from the inner chamber to the outer chamber is exit hole 66 (FIG. 2) in the cylinder 55. This exhaust exit 66 is located approximately 330° from the outer chamber exhaust 56 and is separated therefrom by a barrier 68 which forces the exhaust from the inner chamber to travel approximately 330. around the length of the annular outer chamber 26B, thus providing a residence time at chamber temperature typically at least one second for combustion of residual carbon particulates in the exhaust gases. A third air inlet 70 (FIG. 2) leading into the annular outer chamber 26B through a ceramic fiber tube 72 provides oxygen for virtually complete combustion of the uncombusted pyrolytic gases and carboneous particulates which exit the inner chamber 26A. This air inlet is preferably located approximately 15° downstream from the hole 66 through which the exhaust gases pass from the inner chamber 26A and enter the annular outer chamber 26B. In traveling around the annular outer chamber 26B, the gas temperature drops from about 1700° F. to 1100° F. when it exits the outer chamber 26B through the tube 50. This temperature drop is caused by the heat loss through the shell insulation. Heat loss from the inner chamber is thus reduced so that the desired high temperature within a preferred range of 1500° F. to 1800° F. can be maintained in the combustion chamber particularly with waste loads having a high moisture content. A combustion chamber temperature significantly greater than 1800° F. e.g., 2000° F. has the unwanted result of fusing the ash which leads to problems with the operation of the ash removal system. A two-way air valve 82 directs primary combustion air drawn in through a combustion air inlet 79 through the electric air heater to the upper air inlet 60 for the ignition of the waste. Valves 110 and 111 control the flow of combustion air into the lower air inlets 62 and 70 in a manner to be described hereinafter. At start-up of the incinerator apparatus 10, a solenoid actuated two way air valve 82 is actuated by an electrical signal transmitted from a controller 86 (FIG. 2) to cause the valve 82 to open causing the air to pass through the air heater 59 and then upper air inlet 60 to ignite the waste 13. After a desired chamber operating temperature is reached, controller 86 closes valve 82 and opens valve 110 so that combustion air enters the outer chamber air inlet 70 to cause a reduction in temperature. A thermocouple 88 (FIG. 2) extends into the combustion chamber about one inch below the bearing on the non-driven end of the rotating bar to measure the chamber temperature for the purpose of automatic control of the valves 110 and 111 and the drive motor 22A for the ceramic bar 22.

The lid 14 of the waste storage chamber 12 is a metal cylinder closed at one end by an end wall containing ram 16 embodying a construction and controls to compress the waste and drive the compressed waste downwardly along the storage chamber 12. Lid 14 is hinged along its lower rear edge to an upper surface of the main body of the incinerator apparatus 10 and has a toggle latch (not illustrated) at its diametrically opposite lower front edge. When closed, the lid 14 is pressed firmly on a gasket 90 to form an air-tight seal with the waste storage container 12. The ram fits somewhat loosely in the lid 14. The lower face of the ram in contact with the waste is covered with a two inch thick disc 100 of ceramic fiber insulation. Disc 100 forms the top of the combustion chamber during the combustion of the last remnants of the plug of waste 13 while resting on the rotating bar. The drive end 92 of the screwjack 18 which drives the ram 16 is mounted to a lever 94 having an end which is supported by a spring 96. During extension of the screwjack 16, when the screwjack achieves a predetermined spring overload force, the spring 96 stretches so that a switch 98 is actuated to stop the screwjack drive motor 19. As the plug of waste 13 is moved downwardly in waste storage cylinder 12 by the ram 16, the force on the ram assumes a level less than the spring force exerted applied by spring 96. In such a condition, the spring is caused to be stretched less than the distance required for the lever 94 to actuate the switch and the screwjack drive motor 19 is turned on. If the ram 16 encounters sufficient resistance, however, then the switch 98 is caused to deactivate the motor 19 and the advancement of the ram is ceased.

A tube-like extension 101 protruding from the top of the lid 14 surrounds the screwjack drive tube 18A and an end of the screw rod 18B is secured at the top of the tube against rotation relative to the lid. Operation of the screwjack motor 19 causes the ram 16 to move downwardly to compress and/or move the load of waste 13. A separate, manually operated switch (shown schematically in FIG. 6) permits an operator to raise or lower the ram 16 at will so that lid 14 can be opened for loading waste into the waste storage cylinder 12. A limit switch 102, positioned to sense that the ram has reached the rotating bar, starts a control sequence to automatically shut the incinerator apparatus OFF after the load of waste 13 has been consumed. It will be understood, that the ram 16 may be driven by other suitable means such as a hydraulic or pneumatic cylinder, for example.

The metal shell 24 containing the combustion chamber 26 is surrounded by a cabinet 104. This cabinet or housing, which is similar in appearance to a clothes dryer cabinet, serves to direct cooling air entering through louvers (not illustrated) over the outer surface of metal shell 24 while simultaneously preventing an operator from touching surfaces that are uncomfortably hot. The cabinet 104 also serves to cover the motors, blower, tubes, hoses and other unsightly hardware. An access door (not illustrated) is provided in the front of cabinet 104 for periodic replacement of the paper ash bag 40.

Figure 6:
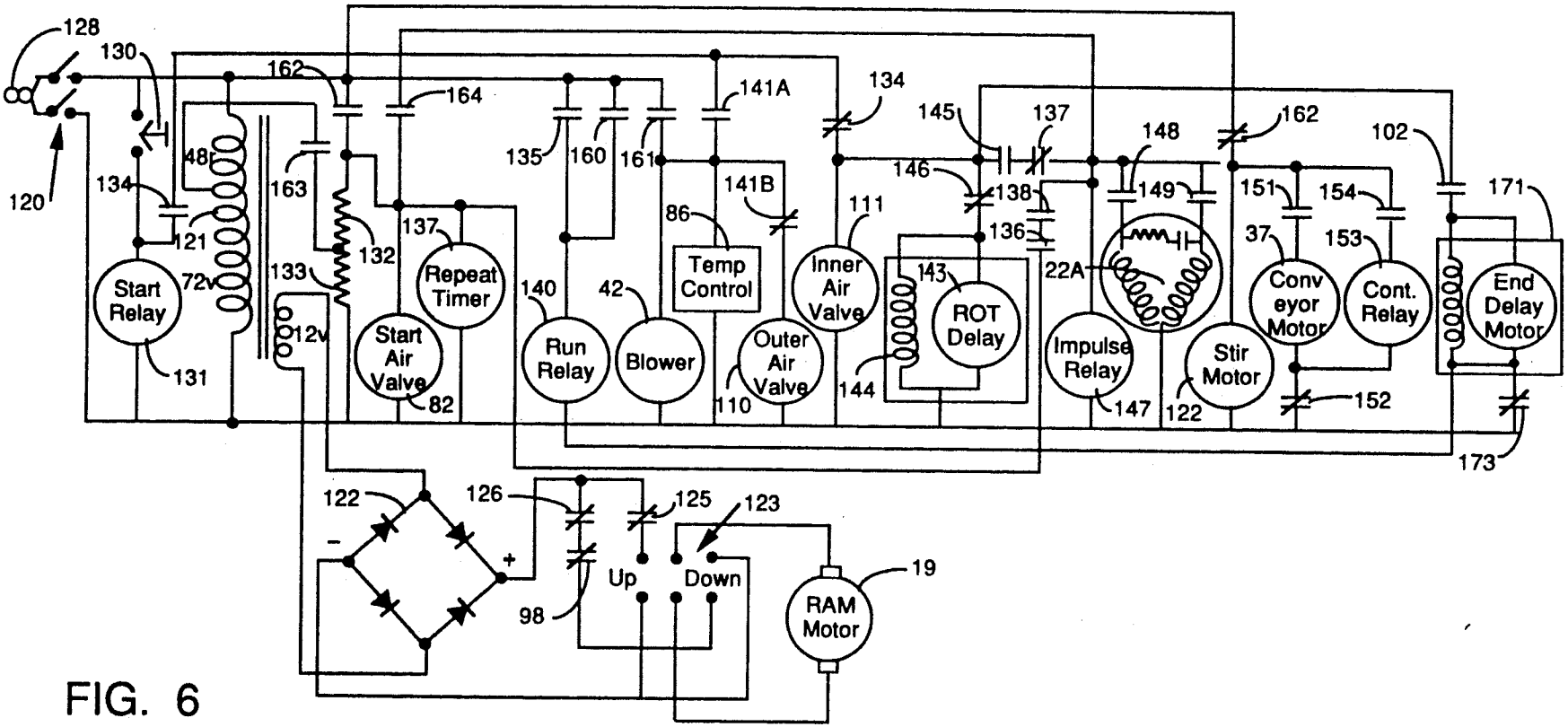
FIG. 6 is a schematic diagram illustrating the electrical circuitry of the integrated control and operation systems of the fully automatic incinerator apparatus of the present invention.

With reference to FIG. 6 there is illustrated the circuit diagram for the automatic control of the waste incinerator. The circuitry is divided generally into five parts namely: the ram control circuitry; the start-up control circuitry; the temperature control circuitry; the ash conveyor circuitry; and the shutdown circuitry.

An electrical supply includes the line cord and plug 28 and the power switch 120 which supplies power to all of the circuits. A transformer 121 supplies 12 VAC power to the ram control circuit and, as an autotransformer, provides lower AC voltages to an outer air heater element 132 and an inner air heating element 133 of air heater 59. Rectifier 122 supplies 12 VDC for the operation of the screwjack drive motor 19. A double pole, double throw center off toggle switch 123 is operated to control the position of the ram. With the toggle switch in the down position, the ram movement is limited by the ram force limit switch 98 and the ram down limit switch 126. With toggle switch 123 in the ram up position, the ram movement is limited by the ram up limit switch 125. The ram control circuit also permits the operator to move the ram up and down at will regardless of the temperature in the combustion chamber.

The operation of the ram control circuit will now be described. Assuming that the power plug 128 has been inserted into 115 V AC 60 Hz receptacle, the operator closes switch 120 to apply electrical power to transformer 121 and all the control circuits. The transformer supplies 12 V AC to the bridge rectifier 122. When the toggle switch 123 is in its center position, no power is applied to the ram drive motor 19 and the ram remains stationary. When the operator throws the toggle switch to the up position, the polarity of the DC voltage applied to the ram motor causes the ram to be lifted until a pin on the ram opens limit switch 125 which stops the ram movement. The lid can now be opened and waste material loaded into the waste storage chamber. When the lid is closed, the operator throws the switch to the down position and the polarity of the DC voltage applied to the motor is reversed causing the motor 19 to rotate in a direction to drive the ram downward in the waste storage cylinder 12. The downward movement is stopped by either operation of the ram force switch limit 98 whenever the downward force attains a value set by a spring inside the ram or by a pin in the ram contacting and opening a lower limit 126. When the waste load moves down as the bottom of the load burns away the force on the ram is reduced causing switch 98 to close and motor 19 to rotate to move the ram further downward. Switch 126 is the down limit switch which is actuated by a pin in the ram to stop the ram when the ram has reached its maximum downward extent of travel.

The start-up control circuit controls the operation of the incinerator from the time that the operator presses the momentary switch start button 130 until the temperature controller 86 has operated in response to an output voltage from the thermocouple 88 which indicates that the desired chamber operating temperature has been reached.

The start-up circuit consists of the momentary switch start button 130, the four pole, double throw relay 131, the inner heating element 132 and the outer heating element 133 of air heater 59, the start-up air valve 82, the blower 42, a repeat cycle timer motor 137 and a repeat cycle timer contacts 136.

The temperature control circuitry includes a three pole, double throw, run relay 140, the thermocouple input temperature controller 86 having normally open output contact 141A and normally closed contact 141B. Also included are the temperature control inner and outer air valves 110 and 111, the rotation delay reset timer consisting of a timer motor 143, a clutch 144, normally open output contact 145 and a normally closed output contact 146, any impulse relay 147 having a normally open contact 148 and a normally closed contact 149, and the rotating bar drive motor 22A. The impulse relay 147 acts to alternately operate the two contacts 148 and 149 each time the relay is energized so that the rotation of motor 22A will reverse direction each time the bar is rotated.

The ash removal circuitry consists of a normally closed contact 162 on the start relay 131, the stirrer motor 122, the upper ash level limit switch 151, the lower ash level limit switch 152, and the control relay 153.

The shutdown circuitry consists of the ram lower limit switch 102, the end delay timer 171 having a normally closed contact 173 which opens when the time runs out.

The circuit operation for start up of a burn will now be explained. Power switch 120 is closed by the operator to apply electrical power to all of the circuit as well as to energize the power transformer 121 which provides 12 volts AC to the ram control circuit so that the ram can be operated as herein before described for loading waste material in chamber 12 at any time before start-up.

To begin a burn, the operator presses the momentary switch start button 130 This energizes the four pole start-up relay 131 which locks itself closed through the normally open contact of contact pair 134 of this relay. The energizing of relay 131 closes contacts 162 and 163 to apply power to the air heaters, to energize the solenoid of the start air valve 82, and to energize the repeat cycle timer motor 137 which runs continuously when energized and closes contact 136 by a cam for 10 seconds each minute. When normally open contact 164 on the start-up relay 131 is closed during start-up and the timer cam has closed contact 136, then voltage is applied to the bar rotation motor 22 to rotate the bar 22 for 10 seconds. The normally open contact of contact pair 135 on start relay 131 is closed to energize the three pole double throw run relay 140 which, in turn, through the normally open contact of contact pair 160 on this relay locks itself closed. The normally open contact 161 on the run relay closes to apply electrical power to the blower 42 and to the electronic temperature controller 86. Since the temperature in the combustion chamber is below the set point during start-up, the normally open contact 141 of the temperature control output relay is immediately closed to apply power to the start-up relay contact pair 134 which causes the start-up relay to lock itself closed. When the temperature exceeds the controller 86 set point at the end of start-up, the temperature controller output relay contact 141 opens to remove power from the lock in contact 134 on the start-up relay 131 and thus deenergizes the start-up relay 131 which in turn deenergizes the start-up air valve solenoid 82, the air heaters 132, 133 and the repeat cycle timer motor 138, thus ending the start-up period.

The "run" or temperature control period of the incinerator operation begins when the outer chamber temperature reaches the set point temperature of temperature controller 86 and causes the controller output relay contact 141 to open thus deenergizing the start-up relay 131. The run relay 140 remains energized through the lock in contact 160, so that the blower 42 and the electronic temperature controller 86 continue to operate after the start-up relay 13 is deenergized. Because the temperature is above the set point temperature of the controller when the start-up relay 131 opens, the normally open contact 141A of the controller output relay is open and the normally closed contact of 141B is closed so that a solenoid 110 of the temperature control outer air valve is energized to cause the temperature of the inner chamber to fall.

When the temperature of the inner chamber goes below the set point, the controller normally open contact 141 closes to energize the solenoid 111 on the inner air valve to direct air to the inner chamber and thereby cause the temperature to rise. The solenoid 111 is prevented from operating during the start-up period by the normally closed contact of contact pair 134 on the start-up relay. At the same time the temperature control inner air valve 111 solenoid is energized, the thirty second reset timer which delays bar rotation is energized. The reset timer clutch 144 is energized directly when the timer motor is energized through the normally closed contact 146 of the timer. When the 30 second rotation delay timer has run out, timer contact 146 opens to stop the timer motor and timer contact 145 closes to apply power to the bar rotation circuit. Normally closed contact 137 and normally open contact 138 on the start-up relay 131 prevent current appearing o contact 145 from operating the repeat timer motor after the start-up is over. When the temperature rises above the set point temperature of the controller because of new fuel fed to the inner chamber by the bar rotation, the normally open controller output contact 141A opens, causing bar rotation to stop and causing the clutch to be deenergized so that a spring resets the timer thus closing contact 146. Opening normally open contact 141A and closing the normally closed contact 141B also deenergizes the temperature control inner air valve 111 and energize the outer air valve 110 so that air goes to the outer chamber to lower the temperature. When power is applied to the bar rotation circuit through timer contact 145, the impulse relay 147 is energized to switch between contacts 148 and 149 so that the bar drive motor reverses direction. The temperature control circuitry operates in this manner to maintain the set point temperature until the entire load of waste is consumed and the ram bar has moved down to close the contact of the ram down limit switch 102. This switch starts the end delay timer 171. Delaying the complete shutdown permits air flow into the combustion chamber to continue to consume any remaining carbonaceous material and to cool the chamber down rapidly by forced cooling. When the set time e.g. 30 minutes, of timer 171 has run out, normally closed contact 173 on the timer opens to open the circuit that locks in the run relay 140 to deenergize it and thereby remove power from all components except the transformer and the ram control circuit. This also resets the end delay timer. This is the shutdown condition for the incinerator. The three points of air entry into the shell are all closed off by the spring actuated closure of the three air control valves namely, the start-up valve 82, the inner air valve 111 and the outer air valve 110. Without a source of air, combustion stops and the combustion chamber cools down by conduction.

The ash removal system is energized at the end of the start-up period when the normally closed contact of contact pair 162 on the run relay 140 closes to energize the stirrer motor which runs continuously throughout the burn and shutdown periods. As ash builds up in the inner combustion chamber the sensing head rises until the ash level upper limit switch 151 is closed. The screw conveyor motor runs to lower the ash level. After a drop of perhaps only one eighth inch, the upper limit switch 151 reopens. Since it is desirable to prevent too frequent operation of the screw conveyor, control relay 153 with normally open contact 154 locks in the keep the conveyor motor running after the upper limit switch 151 has reopened. When the ash level has dropped to the level where the lower limit switch 152 opens, the conveyor motor stops and the control is deenergized so that lock in contact 154 reopens.

The operation of the incinerator apparatus 10 of the present invention is as follows. In order to use the incinerator to burn about a bushel of mixed newspaper, magazines, and garbage, the operator first actuates the manual switch to lift the ram 16 to its uppermost position. With the ram up, the front edge of the lid can be unlatched and lifted and the lid tipped back on its hinge until it rests against a stop (not shown).

If the incinerator is to be used for the first time or if the plug of waste 13 has been burned out completely, then an inch or so of paper such as newspapers folded into quarters must be loaded into the bottom of the storage chamber 12. The paper will be supported by the rotating bar 22 and by the corners of the paper which are bent upwardly against the inside of the cylindrical waste storage cylinder. Once the storage cylinder is properly lined at its base with the paper, magazines, trash and other sorts of waste may then be loaded randomly.

The load of waste 13 will form a seal against the inside of the waste storage cylinder 12 so that radiation and hot gas from the combustion chamber 26 will not reach the under side of the ram 16. Since the storage cylinder 12, the lid 26, and the space occupied by the ram are all air tight, there is no air in the storage cylinder to support undesired combustion of the waste within the storage cylinder proper.

After the waste storage cylinder 12 is filled, the lid 14 is closed and latched and the ram is actuated by the manual switch to compact the waste. A ram force of about fifty pounds is sufficient to crush milk cartons and some plastic bottles if such waste is to be incinerated. After initial compaction, the ram can be raised and additional waste loaded if desired. When the lid 14 is closed and latched, the incinerator is then ready for start up.

The user then presses an unillustrated "START" button, whereby the blower 42 is activated so that the combustion chamber 26, waste storage chamber 12, and lid 14 are all below atmospheric pressure. At the same time, the solenoid on the two way valve 82 is energized by the controller 86 so that combustion air is directed by valve 82 to pass through conduit or hose 106 to enter the combustion chamber through the heater 59 and the upper air nozzle 60 at approximately 1200° F. The 1200° F. air directed onto the under side of the plug of waste paper ignites the paper in about four minutes. After the moment of ignition, the temperature in the combustion chamber rises rapidly. When the temperature measured by the thermocouple 88 reaches the set point of the controller 86 of approximately 1700° F., the controller relay deenergizes solenoid valve 82 and energizes the outer air valve 110, thus stopping the air flow to the start up nozzle 60 and initiating air flow into the outer chamber through tube 72. Simultaneously power is discontinued to the electric heating elements 133 and 132. With air shut off to the inner chamber 26A and introduced into the exhaust gas stream the temperature of the combustion chamber 26 will drop. When the temperature goes below the set point, a bar rotation time delay relay 22B will start timing and, simultaneously, the inner chamber air is turned on, by energizing the inner chamber air valve 110. Inner chamber air from the atmosphere passes through inlet 62, ceramic fiber tube 64, and into the inner chamber 26A where it may cause the temperature to rise. If the temperature does not rise above the set point by expiration of a time delay of perhaps 30 seconds, this indicates that there is no char in the chamber 26 to burn. When the timer 143 and 144 of the bar rotation time delay relay runs out, rotation of bar 22 by motor 22A is automatically started. Rotation of the bar 22 will cause char to be abraded and fall into the inner chamber 26A whereat it is combusted. This causes the temperature to rise above the set point so that the air is switched again by deenergizing inner chamber control valve 111 and by energizing the outer air control valve 110. Concurrently, the rotation of bar 22 is stopped, and the timer of the rotation delay relay is reset to zero. By using the time delay, large chunks of char in the inner chamber 26A are given the opportunity to burn up completely before more char is dumped in. This sequence repeats indefinitely as long as there is waste to be burned in storage cylinder 12. During operation, the plug of waste 13 gradually moves downward under the pressure of the ram 16 and the direction of rotation of the bar is preferably reversed after each rotation so that the char is distributed symmetrically on the bottom of the combustion chamber 26.

An alternate control method would be to provide air to the outer chamber 26B at all times and intermittently open the inner air valve to introduce air into the inner chamber 26A when the temperature drops below the set point. This method would provide excess air to the outer chamber 26B to ensure the combustion of the unburned combustible gases and particulate which are driven through exit hole 66 in the cylinder 55 when air is directed into the inner chamber 26A through inlet 62.

The cold waste 13 moves down the metal storage cylinder 12 and passes into the lower six inches of the storage cylinder which is formed by the rings of fiber ceramic insulation 20. In this insulated portion of the storage cylinder, the plug temperature gradually increases from the cold fresh waste temperature up to the 1700° F. temperature of the combustion chamber. At approximately four inches above the burning surface, the temperature is high enough to scorch the waste. At approximately three inches, destructive distillation begins to take place and volatile combustible gases are driven out of the waste and into the combustion chamber where they burn. Distillation is complete at about one inch above the burning surface so that a plug of pure carbon char rests on the rotating grate bar 22. This char also contains the ash which is as much as 20% of the unburned weight of the waste. When the bar 22 rotates it scrapes off char across the center of the plug of char. Parts of the plug in the sector between the bar and the ceramic fiber chamber 20 wall fall in sheets or chunks to the top surface 28 of the ash where they burn. Layers of ash thus do not form at the surface of the plug where they would prevent combustion of the carbon. The char which falls off the load of waste and into the combustion chamber is always in sufficiently small pieces so that air fully reaches the carbon and the pieces are burned completely to ash.

Approximately two inches of ceramic fiber board 100 is placed on the bottom surface of the ram 16. The ram moves down until this insulation reaches the top of the rotating bar 22, at which time all of the plug 13 will have been consumed. This design has the disadvantage that the lid 14 cannot be lifted and new waste added when the plug has a thickness less than about six inches. To do so would break the seal and expose the fire in the combustion chamber. As a safety feature, an electric interlock on the lid latch could prevent the lid from being lifted whenever the remaining plug is less than six inches in thickness.

The ash product 30 from paper and kitchen waste is powdery and behaves somewhat like a liquid. However, the ash generally will not spontaneously flow downwardly in the cone 32 to enter the screw conveyor 36, but instead tends to form a bridge over the entrance to the conveyor. A stirrer device comprising two flat pitch blades 118 mounted on a rotatable vertical post 120 which is sealingly and rotatably supported in packing 121 is provided in order to sufficiently agitate and break up the ash 30 such that it will have a horizontal surface like a liquid and readily pass into the entrance of the conveyor 36. The post 120 is driven at about five rpm by a gear motor 122 which is located at the extreme bottom of the incinerator 10. The stirrer is turned on at the end of the start-up period and runs continuously through shutdown. The metal cone 32 which supports the ash 30 is open to the interior of the shell 12 and is thus cooled by the air which the blower 42 draws into the cabinet through cooling air inlet 38. Therefore, by the time the ash reaches the screw conveyor 36 which transports to ash to the paper bag 40, the ash has cooled to approximately 150° F. or less.

Since the ash surface 28 which forms the floor of the combustion chamber, should always be within one half inch of its desired position, the removal of the ash must be accurately controlled. Thus, the screw conveyor 36 is activated when the ash level is at the high limit and deactivated when it is at the low limit. This activation or deactivation of conveyor 36 is accomplished by the propeller like ash level sensing head which rotates with the stirrer and because of the ski tip leading edge on each of the two arms, slides on the surface of the agitated ash. The propeller also serves to densify the loose flakes of ash which fall from the burning surface into a well defined surface. The rising of the sensing head operates a limit switch which causes the conveyor to remove ash. The conveyor is turned off by a lower limit switch.

The screw conveyor 36 and ash cone 32 serve yet another purpose. The combustion chamber 26 operates below atmospheric pressure and the only way that air can enter is through the upper air inlet 60 or through the lower air inlets 62 and 70. Air must not be permitted to enter the combustion chamber upwardly through the ash since this uncontrolled air flow will interfere with the proper operation of the temperature control system which is dependent on the control of the air entering the inner and outer chamber through valves 111 and 110. In the preferred construction of the present invention, the air seal is provided by the screw conveyor which, during conveyance of the ash, forces ash to completely fill and seal the conveyor tube during transport thereof to the bag 40. Thus, the ash filled conveyor tube is capable of supporting the air pressure differential between the combustion chamber and atmospheric pressure so that no air leaks upwardly through the ash 30. The ash collection bag 40, for purposes of economy, is most preferably a large brown paper bag available at grocery stores and is easily accessible through a door provided in cabinet 104.

The operation of the incinerator apparatus is, as noted at the outset, fully automatic. That is to say, once the user has loaded the waste and pressed the "start" button, he need pay no further attention to the apparatus. The incinerator will shut itself off when all of the waste has been consumed. Moreover, the construction of the apparatus is inexpensive to manufacture, maintain, and operate. For example, from start-up until shutdown, the blower motor 42A and the stirrer motor are the only continuously operating elements within the incinerator apparatus 10. The remaining energy consuming elements of the apparatus, i.e., the start-up heaters the screwjack motor 19, and the screw conveyor motor 37, are operated only occasionally and generally for short time intervals.

As mentioned hereinbelow, the ram 16 can be lifted by the manually actuated switches while the waste is burning so that the lid 14 can be opened and additional waste added until the load of waste is about half consumed. Due to the seal between the waste 13 and storage cylinder 12, no smoke will come out of the cylinder and no fire will be seen. However, the lid should not be left open more than about five minutes during a reload since, the fire will eventually burn upwardly along the sides of the storage chamber 12 and destroy the air seal formed between it and the waste.

The incinerator apparatus of the present invention is inherently safe because a power failure will shut off the exhaust blower 42 which provides the combustion air to the inside of the metal containment 24 and will close all of the air valves controlling air flow into the metal containment. Lacking combustion air, the fire will simply go out. Furthermore, when the incinerator is burning, there is no place on its exterior which is at a temperature which can cause a burn. Even the exhaust pipe 54 is below 200° F. which, while maybe too hot to hold one's hand on, is not hot enough to cause a burn.

The incinerator is efficient in that it burns waste completely at a minimum expenditure of electrical energy; and it is clean-burning in that the exhaust gases produced thereby are essentially free of smoke, odor and suspended ash.

Although in the embodiment shown in FIG. 1, the incinerator apparatus 10 is provided with a single rotating bar 22 to support the plug of waste 13 and to remove char from the bottom thereof, two or more rotating bars of lesser diameter could be used to reduce the size of chunks of char that fall into the combustion chamber if such is desired. However, a single rotating bar design is preferred in this embodiment since it is believed to represent the simplest and least costly design. When it is desired to replace the rotatable bar 22 by two more bars, the action of suitable drive means will intermittently reciprocate along a diameter in sufficient frequency and magnitude to abrade only the quantity of charred material from the plug of waste 13 which is required to maintain combustion rate and temperature at optimum levels.

FIGS. 7–11 illustrate the preferred embodiment of an incinerator according to the present invention and includes distinguishing features of: a) elimination of the slight funnel shape of the fibrous ceramic portion of the waste storage chamber and the provision of two rotating bars for supporting the load o waste; and b) the provision of two start-up air heaters to increase the supply of heated air to the surface of the waste exposed in the space between the two rotating bars; c) provision of a spark arresting chamber in the flow path of waste gases between the annular exhaust chamber and the exhaust mixing tube; d) provide a ash level sensor with a more robust design and better heat resistance, and e) provides a rearranged placement of parts to fit into a cabinet which is the size and shape of a household clothes dryer. The same reference numerals have been applied to identify parts described hereinbefore in regard to FIGS. 1 and 2 and utilized in the embodiment shown in FIGS. 7–11.

With reference to FIGS. 7–11 there is illustrated a waste incinerator apparatus 10A which includes a vertically arranged metal cylinder forming the upper half of a waste storage chamber 12 into which a load or "plug" of waste 13 to be incinerated is loaded. The lower half of the waste storage chamber is made of fiberous ceramic material. The lid 14 for waste storage chamber 12 supports a piston 16 which is moved up and down in the chamber 12 by the motor driven screwjack 18. The piston 16 initially compresses the waste 13 and during the incineration process, and moves a supply of waste to the bottom of the waste storage chamber 12.

The lower portion, i.e., approximately the bottom six inches of the waste storage chamber is formed by a cylindrical tube of fibrous ceramic insulating material 20. A lower extension of this cylindrical tube is traversed by two cylindrical ceramic bars 22Z rotatably supported at their opposite ends by anti-friction sleeve bearings 23 mounted in the metal shell 24 of the incinerator. The bars are connected together by a chain and sprockets 25A and driven by a single gear motor controlled by a controller 22X. Bars 22 are spaced apart and occupy an amount of cross sectional area at the exit of the storage chamber as required to support the load of waste and prevent it from falling or collapsing into the combustion chamber 26A. Bars 22A also serve to scrape controlled quantities of charred material from the bottom of the load of waste 1 during the incineration process. The rotating bars 22Z are each constructed as in the same manner as previously described in regard to bar 22 and shown in FIG. 3. The combustion chamber 26 embodies the same construction and is used in the same manner as previously described in regard to bar 22 as described and shown in FIGS. 1 and 2.

Figure 10:
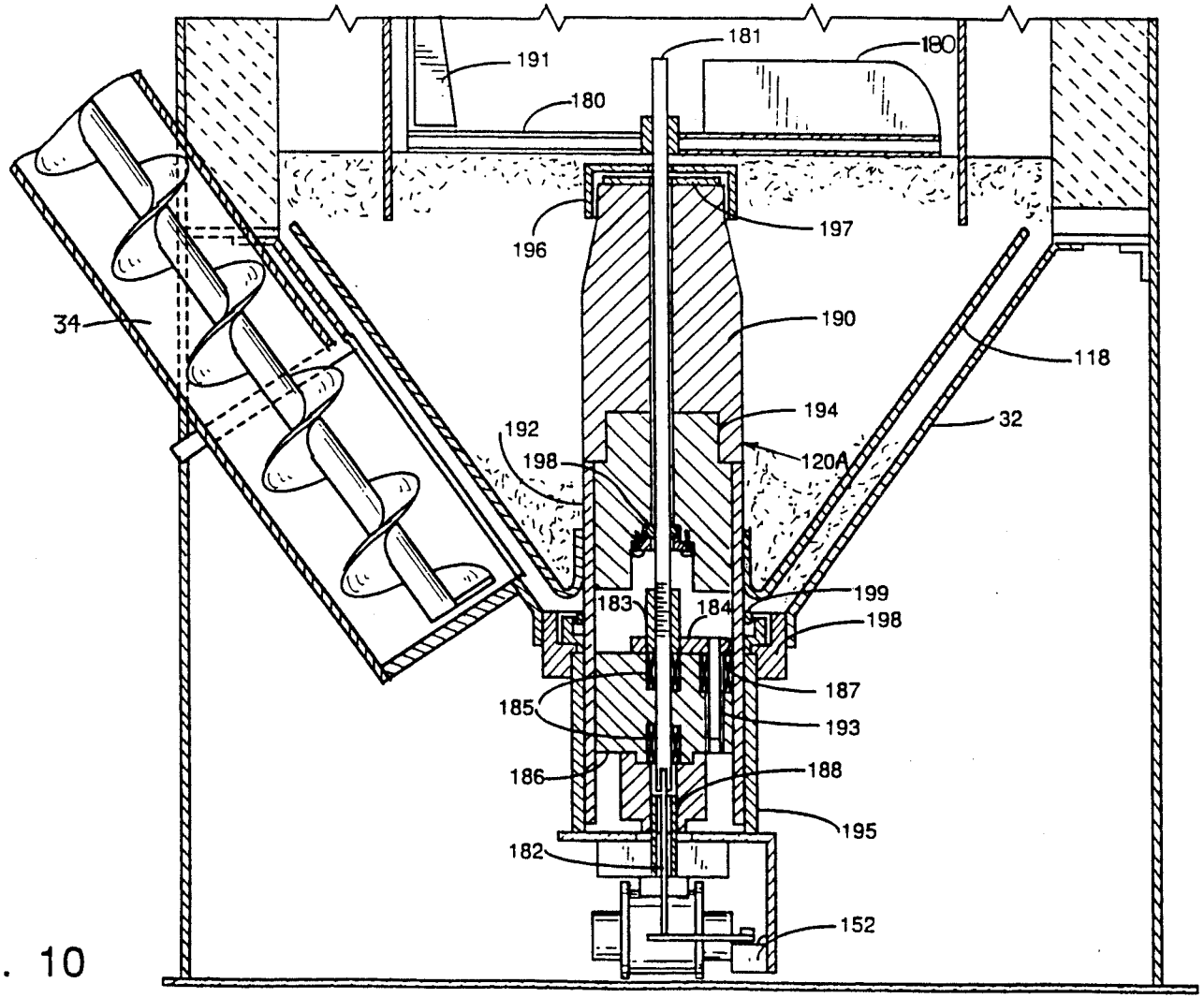
FIG. 10 is a sectional view taken along lines X—X of FIG. 7.

In FIG. 10 there is illustrated a preferred embodiment of the apparatus forming the bottom of the combustion chamber whereby a bed of ash is maintained at a predetermined thickness to allow high temperature operation of the combustion chamber while, at the same time, provide a thermal insulating barrier for the structure used to maintain the ash bed. Of particular importance in the preferred embodiment of the present invention is the use of the heat sink to prevent thermal damage to linear bearings which are used to support the propeller post and prevent ash from contaminating the bearings. As shown in FIG. 10, post 120A rotates a metallic head 180 resembling an airplane propeller by the provision of arms extending outwardly from the axis of rotation by post 120A. Each arm embodies a configuration that includes an upturn leading edge followed by a flat skid having a face surface that can ride upon the upper surface of ash to densify fresh ash deposits and provide a element that responds to the elevation of the densified ash. An upper rod portion 181 of post 120A is made of an alloy steel selected to maintain strength at a high operating temperature within the incinerator. Rod portion 181 has a threaded end that is received into a coupling tube 183 used to connect the tube to a bearing shaft. Tube 183 is also coupled to a torque arm 184. The shaft descending from coupling tube 183 is supported by linear ball bearings 185 that are mounted in a cylinder 186 that is in turn fastened to a heat sink tube 192 to rotate with the stir bars 118. Bars 118 are also mounted to the tube 192. Cylinder 186 also supports an additional linear ball bearing 187 that drives a shaft 193 fastened to torque arm 184. By this construction, post 120A and ski head 180 can rise and fall vertically in response to changes to the ash level with no significant friction that might impede the vertical movement while the required torque is applied to rotate the stirrer. An extension from shaft 182 extends downwardly through an opening in a gear box shaft 188. The extension actuates a limit switch 152 to turn OFF the screw conveyor motor 37 when the ash level drops to a minimum level and to turn on the screw conveyor motor 37 when the ash level has reached a maximum level.

A ceramic cylinder 190 insulates support posts 120 from the hot ash and rotates with the stir bars 118. Cylinder 194 is supported by heat sink tube 192. Heat conducted downwardly by the post 120A is transferred across the clearance to the heat sink cylinder 194 and then to the heat sink tube 192 and finally through the journal bearing to the stationary bearing tube 195 which is cooled by atmospheric air which is drawn across the underside of the ash support cone 32. Stationary bearing tube 195 supports the entire rotating assembly and is suspended on the lower end of the ash support cone 32 by a ring 198 that also carries a seal 199 to prevent ash from entering the lubricated journal bearing. A clearance is maintained between cylinder 190 and post 120A to thereby avoid frictional interference to vertical movement of the post 120A. As shown in FIG. 10, an empty space exists above cylinder 186 and at the bottom of cylinder 194 which allows the propeller to raise and fall throughout a distance of about an inch as the ash level varies. An inverted cup 196 rotates with the propeller and cylinder 190 to prevent ash from collecting on the top of cylinder 190. Washer 197 forms a loosely fitting relation on post 120A while preventing ash from entering the space between cylinder 190 and post 120A. A felt washer 198 in a gland on the under side of cylinder 194 offers a further barrier preventing contamination from dust in the linear bearings 195 and 187. The combination of the insulating cone 190 and the heat sink construction limits the temperature to which the linear bearings 185 attain even though the ash surface at the rotating ski tip head may reach a temperature of 2000° F.

Figure 7:
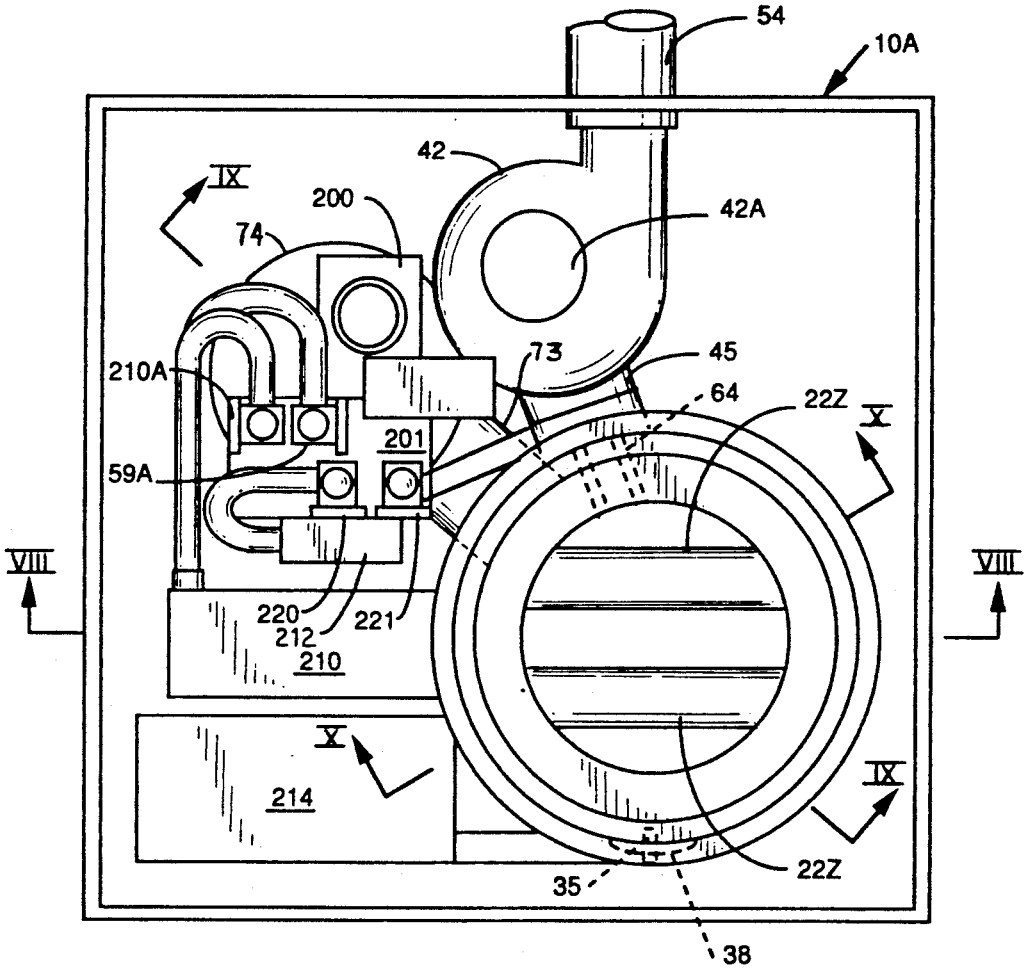
FIG. 7 is a plan view of an incinerator apparatus with the top portion of a cabinet removed and illustrating a preferred embodiment of the present invention.
Figure 8:
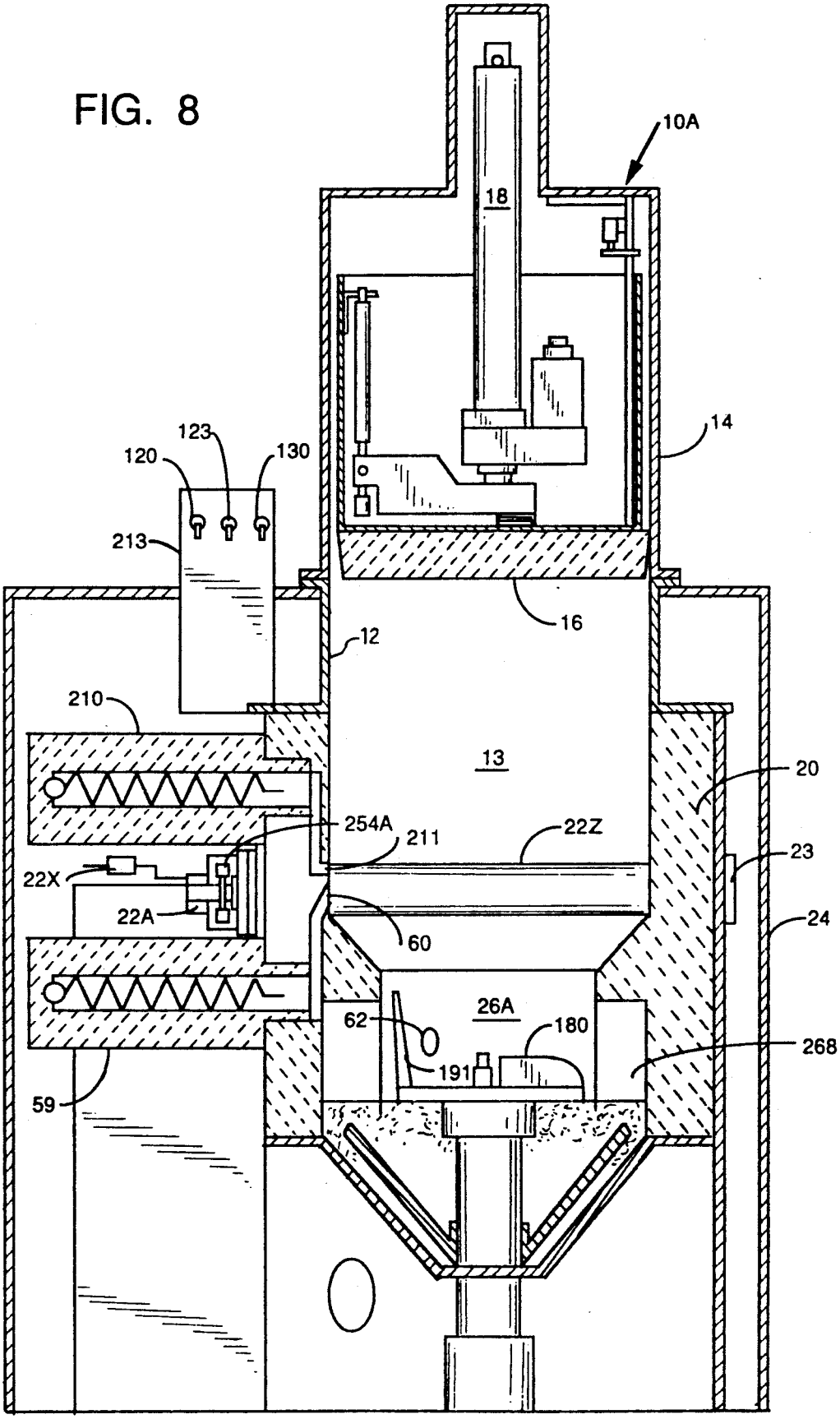
FIG. 8 is a sectional view taken along lines VIII—VIII of FIG. 7.
Figure 9:
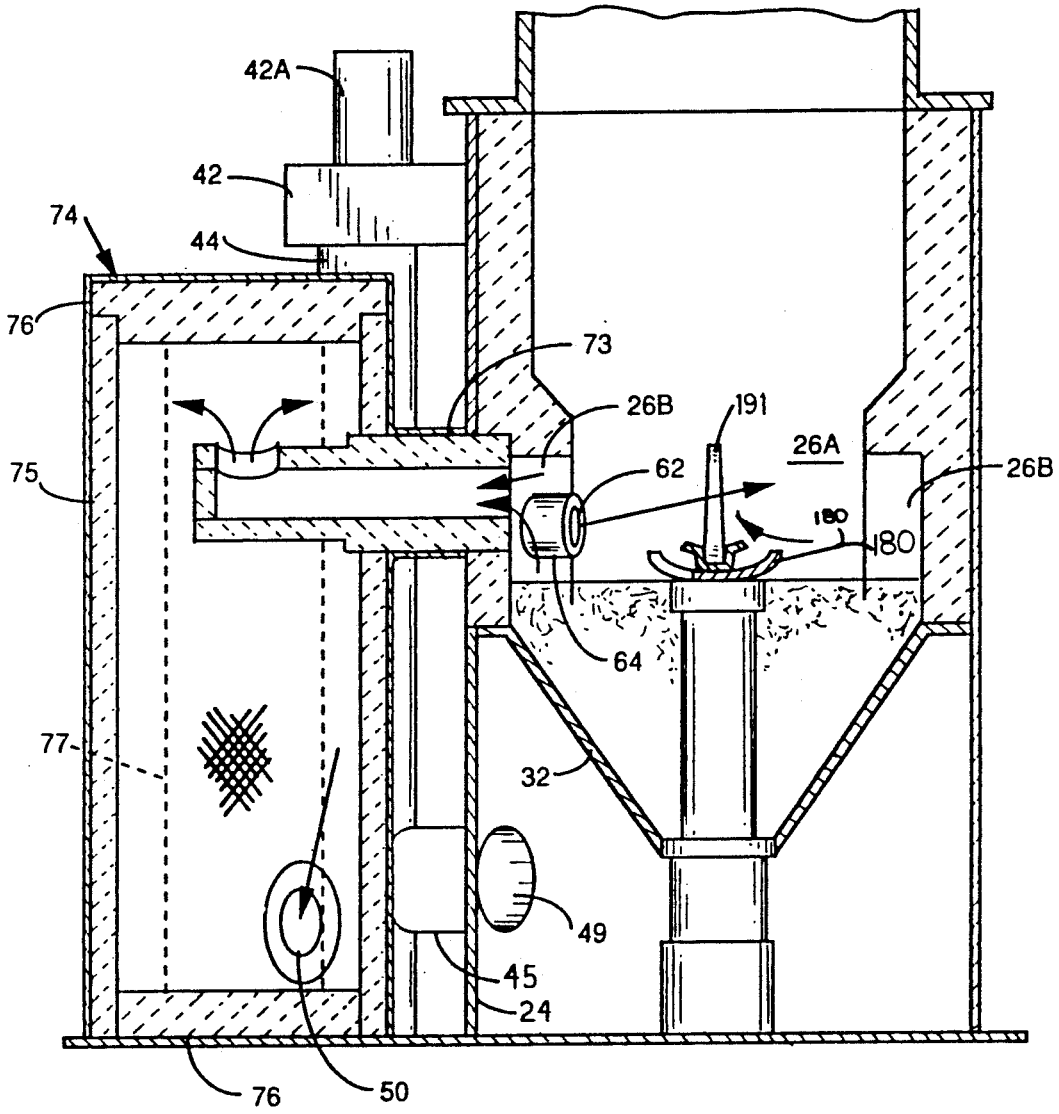
FIG. 9 is a sectional view taken along lines IX—IX of FIG. 7.
Figure 11:
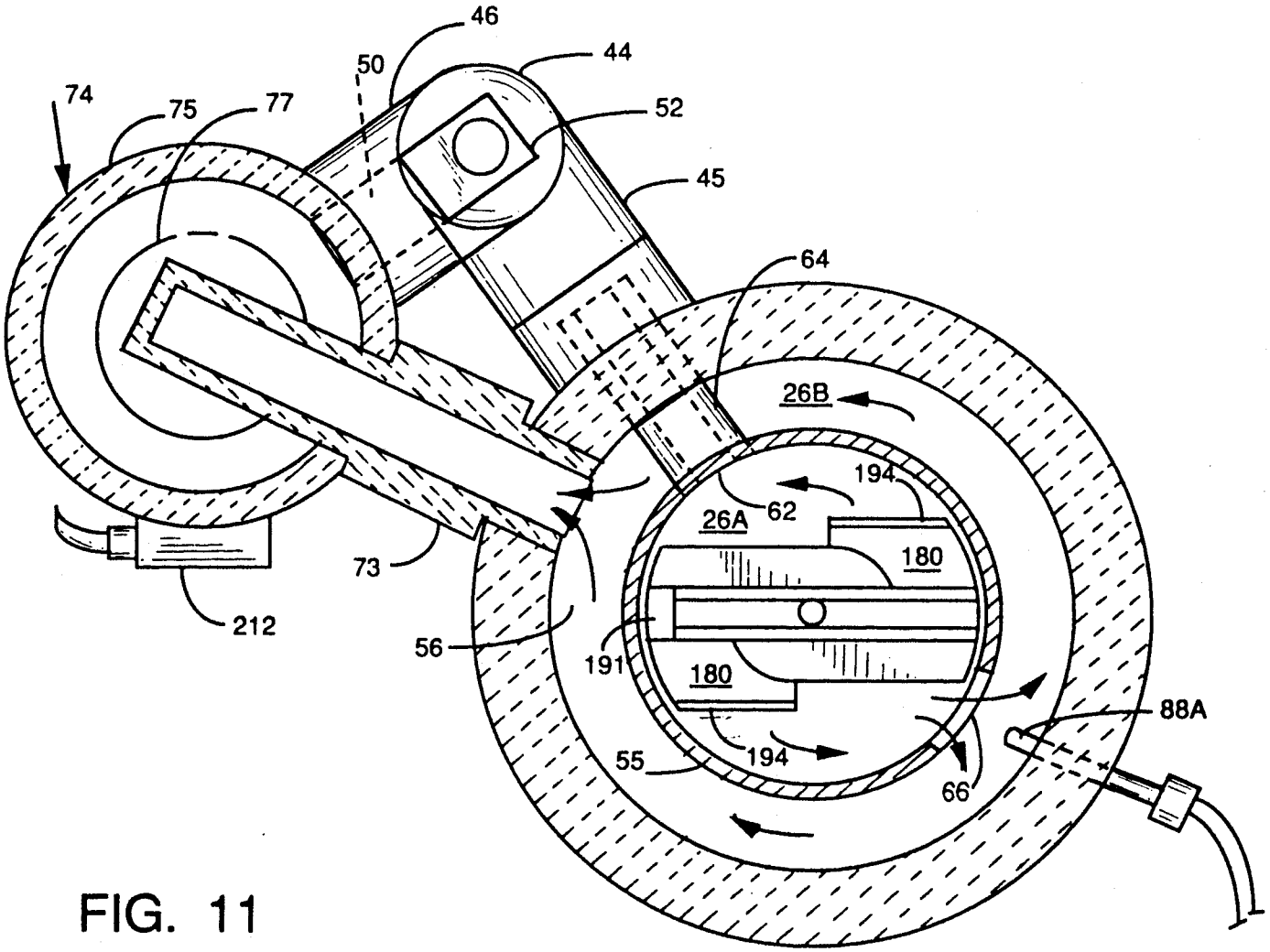
FIG. 11 is a sectional view taken along lines XI—XI of FIG. 7.

Referring to FIGS. 7, 9 and 11, a blower 42 driven by a motor 42A, is attached to the top of mixing tube 44. Blower 42 draws air into the mixing tube through a short pipe 45 which communicates by opening 49 with the air space enclosed by metal shell 24 below the ash support cone 32. The cold air enters this air space from the inside of the cabinet through opening 35 in the access door 38 at the front of metal shell 24 (FIG. 7).

Exhaust from the outer annular combustion chamber 26B passes through a horizontal ceramic fiber tube 73 to enter a spark arrestor chamber 74 which includes a metal cylinder with a sheet metal top and a bottom all lined on the inside by insulation comprising a tube of ceramic fiber insulation 75 and top and bottom ceramic fiber discs 76. Inside this chamber is a tube of stainless steel screen 77. Exhaust tube 73 extends through an opening in this screen to introduce the exhaust gases of the combustion into the center of the screen tube where the screen entraps and thereby filters out any sparks remaining from combustion.

The exhaust gases pass from the annular space outside the screen 77 through a ceramic fiber tube 50 contained in an air tight sheet metal tee 46 to enter the mixing tube 44 near its lower end. A ceramic fiber cap 52 on the end of tube 50 directs the hot gas from the spark arrestor chamber 74 upwardly into mixing tube 44 where the hot gas mixes with the cold air drawn in by the blower 42 through pipe 45 and inlet 38 to reduce the temperature of the combustion exhaust gas to below 200° F. The exhaust from the blower exits the building through a vent pipe 54 in the same manner in which a household dryer is vented.

Hot exhaust gases flow from the outer combustion chamber 26 through the exhaust tube 73. This tube is preferably about three inches above the minimum level of the ash surface during normal operating conditions of the incinerator. The pressure drop across the orifice opening 35 in the access door 38, when blower 42 is activated, causes the entire interior of the incinerator shell 24, the waste storage chamber 12 and the lid 14 to operate below atmospheric pressure. Air for combustion enters through four different openings each under the control of a solenoid operated valve. However, the suction pressure developed by the main blower 42 is not sufficient to overcome the pressure drop across a valve at the required air flow of about 2.5 CFM.

For this reason, a positive pressure blower 200 (FIG. 7) is used to develop a pressure of about 0.8 inches of $H_2O$ in the manifold box 201. Each of the four solenoid control valves 59A, 210A, 220 and 221 are mounted of this manifold box. Energizing a valve permits air to pass with the desired flow from the manifold box 201 through a length of tubing to the appropriate air entrance.

The first air entrance point is through the lower electric air heater 59 from where air at about 1200° F. enters the inner combustion chamber at the level of and between the rotating bars 22Z and is directed upward by the inlet nozzle 60 to impinge on and ignite the bottom of the waste material 13. An upper air heater 210 likewise delivers hot air through inlet nozzle 211 but directed horizontally parallel to and between the bars. A third air inlet 62, FIG. 11, leads into the inner chamber 26A at a level about two inches above the ash surface through a ceramic fiber tube 64. Tube 64 passes through the outer annular chamber 26B, penetrates cylinder 55 and enters the inner chamber at a point approximately diametrically opposite the exhaust hole 66 in cylinder 55. A small diameter nozzle hole at the exit end of tube 64 directs high velocity air down onto the surface of the ash to cause high turbulence and the rapid combustion of any resident carbonaceous material. The passage of exhaust gases from the inner chamber to the outer chamber is through exhaust hole 66 (FIG. 11). The exhaust gas from chamber 26B divides into two flow paths to reach the outer chamber exhaust exit 56. Dividing the flow of exhaust into two paths reduces the gas velocity so that the ash particles may settle out onto the ash surface at the bottom of the outer chamber for removal by the screw conveyor 36. A fourth air inlet 212 (FIG. 11) in the top of the spark arrest chamber supplies oxygen in atmospheric air for the complete combustion of the uncombusted pyroltytic gases and any burning or hot carbonaceous particles, i.e., sparks, which enter the spark arrest chamber.

Thermocouple 88A is located in the outer annular chamber at the center of the exhaust hole 66 in the inner chamber cylinder 55. The thermocouple 88A provides an electrical output signal to the controller 22X which energizes the motor 22A according to a control mode which operates the motor when the temperature measurement by the thermocouple falls below a set point temperature by the controller. The motor is energized for a brief period suffice to scrape char from the plug of waste by rotating the bars. At this location, the thermocouple responds very quickly to the exhaust gas temperature, which is essentially the chamber temperature, and at the same time it is shielded from impingement with chunks of ash or char which might otherwise contact and shield on the thermocouple, preventing a rapid response time. To further prevent ash or char from covering the exhaust hole 66, a vertical post 191 has been placed at the end of the ash level sensing propeller 180 so that chunks of ash will be scraped away from the exhaust hole 66.

The operators controls for the incinerator includes a power switch 120 which controls the supply power to all the circuits, an up/down switch 123 to control the ram, and a momentary "START" button 130. These switches are mounted on a small control box 213 which projects up above the top of the control cabinet at the back in much the same location as the controls for washers and dryers. All other control components, such as the thermocouple temperature controller, control transformers, control relays, timers and rectifiers are located in a sealed chassis 214 (FIG. 7) which is located directly above the ash conveyor 34. Each electrical component has a detached cable which plugs into a suitable receptacle on the side of the chassis.

Figure 2:
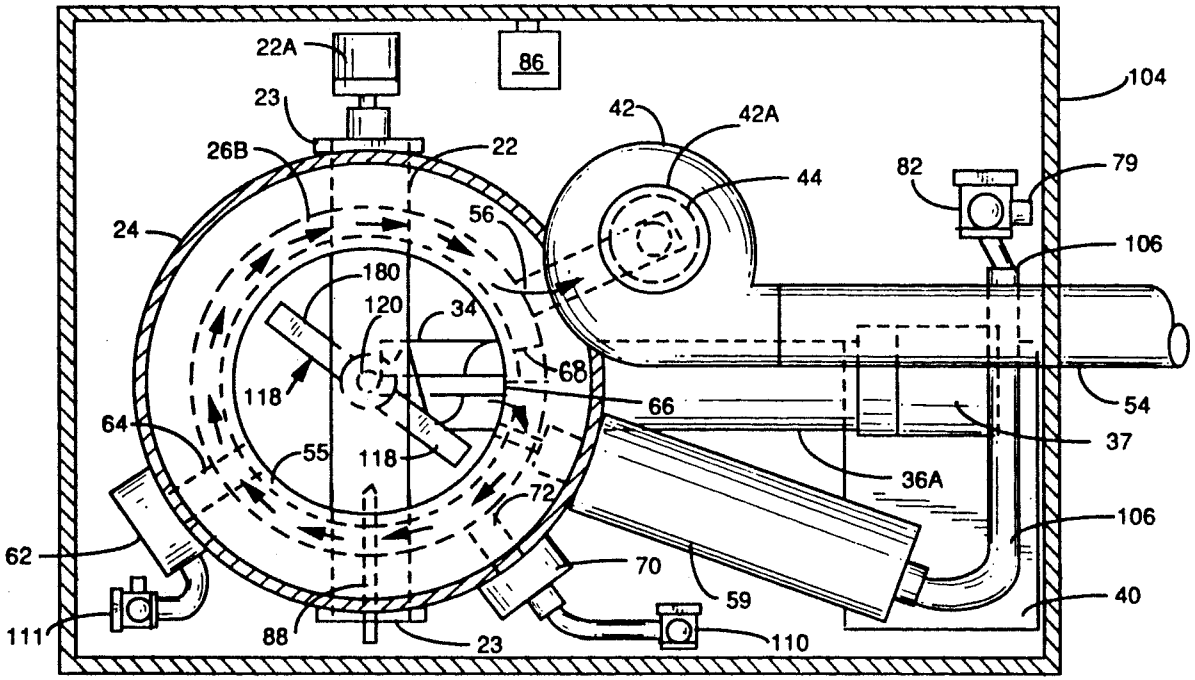
FIG. 2 is a plan view in partial section with the waste material to be incinerated being omitted for purposes of clarity, of the incinerator apparatus of the present invention as seen along line II—II of FIG. 1.

The operator control of the ram for loading of the incinerator is exactly as described in the embodiment of FIGS. 1 and 2. The automatic operation after the "START" button has been pressed is simplified. This automatic operation providing a cycle of operation divided into three time periods which are:

1) A start period beginning at the time the start button is pressed and ending when the inner chamber temperature reaches the temperature controller set point;
2) A run period extending from the event of attainment of set point temperature until the lower ram switch has been actuated, indicating that all the waste has been burned; and
3) A cool-down period which is of predetermined duration, e.g., thirty minutes, determined by a timer which starts when the lower ram switch is actuated.

During the start period, the upper and lower heaters 59 and 210 are energized and their associated air control valves 59A and 210A are opened. A control valve 220 is also opened and remains open continuously through all three time periods to supply atmospheric air to the spark arrestor. The bar rotation occurs for short periods of time, i.e., sufficient for about one half revolution of the bars, followed by a thirty second delay, and this cycle repeats continuously during the start-up period. The pressure applied by the ram is on continuously.

The run period is the period where the temperature of the combustion chamber is regulated. In the run period, the air heaters are turned OFF and air valve 59A serving the lower heater 59 is deenergized to terminate this source of air. At the same time, an inner air solenoid operating valve 221 is energized to bring combustion air into the inner chamber continuously through tube 64 and nozzle 62 throughout the run period. If the temperature drops below the set point on the controller, the bars immediately rotate about a half revolution. This will scrape off char which will burn in a few seconds to raise the temperature above the set point and thus prevent any further rotation. If the temperature does not rise to the set point within a fixed time period, e.g., thirty seconds, another rotation of the bars will occur and this sequence will continue until the temperature does raise above the set point.

When the ram has reached its lowest position and actuated the lower limit switch, thus indicating that all the waste has been burned, a timer for cool down is started. Since all the waste has been burned the combustion chamber temperature drops below the set point and the rotation cycle for the bars remains in operation. The inner air valve 221 and upper air valve 210A are continuously energized to provide air to burn any residual char which might remain in the incinerator. The main blower 42 continues to draw air into the metal shell 24 to cool the ash in the ash support cone 32. At the end of the cool down period, the timer shuts OFF the main blower; the combustion air blower; deenergizes all air valves; deenergizes the controller for the bar rotation motor and shuts OFF the controller and stirrer motor. The ram can still be operated manually.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An incinerator apparatus for waste material, said apparatus including a ram feed waste storage chamber in communication with an underlying combustion chamber, a bar having an ash abrading surface traversing the entrance to the combustion chamber while supporting waste material in the waste storage chamber under a compression force imposed by a ram, the ash abrading surface of said bar being operated to loosen and pass charred waste to an underlying combustion chamber, and means for controlling the abrading of charred waste by said bar into said combustion chamber.

2. The incinerator apparatus according to claim 1 wherein said means for controlling includes means for controlling rotation of said bar when the temperature in said combustion chamber falls below a desired temperature.

3. The incinerator apparatus according to claim 2 wherein said ram feed waste storage chamber includes a ram for pressurizing waste material in said storage chamber against said bar, and means for controlling said ram for maintaining a predetermined pressurization of waste material against said bar.

4. The incinerator apparatus according to claim 1 wherein said ram feed waste storage chamber includes a ram for pressurizing waste material in said storage chamber against said bar, and means for controlling said ram to maintain a predetermined pressurization of waste material against said bar.

5. The incinerator apparatus according to claim 1 wherein said bar includes spaced apart bar members transversing said entrance to the combustion chamber.

6. The incinerator apparatus according to claim 5 further including means for discharging a heated air supply across an exposed surface of waste material between said spaced apart bar members.

7. The incinerator apparatus according to claim 1 further including means for supplying a constant air flow to said combustion chamber continually throughout at least the operation of said means for controlling.

8. The incinerator apparatus according to claim 1 wherein said means for controlling includes a controller responsive to the temperature in said combustion chamber for rotating said bar.

9. The incinerator apparatus according to claim 1 further including means for maintaining a negative pressure inside said combustion chamber.

10. The incinerator apparatus according to claim 9 further including means for conducting waste gases of combustion from said combustion chamber and wherein said means for maintaining a negative pressure includes air valves connected by a manifold for supplying the major part of the pressurized air to said means for conducting waste gases.

11. The incinerator apparatus according to claim 10 wherein said control means includes a member rotatable about a vertical axis while supported by the ash and driven to move upon the upper surface of said bed of ash to densify the ash of the combusted waste.

12. The incinerator apparatus according to claim 10 wherein said control means includes a metallic head having an outwardly projecting arms with upturned leading edges followed by a flat skid surface to ride upon the upper surface of the bed of ash, and a shaft coupled to rotate said metallic head while supported by lineral bearings.

13. The incinerator apparatus according to claim 12 further including a heat sink to cool said shaft within said bed of ash.

14. The incinerator apparatus according to claim 10 further including means responsive to the temperature of combustion gases for rotating said bar; and wherein said control means includes an upstanding post driven to move about the bed of ash to scrape and carry ash about the upper surface of said bed of ash.

15. The incinerator apparatus according to claim 14 further including means for conducting hot waste combustion gases from said combustion chamber, and wherein said means responsive to the temperature includes a thermocouple extending in said means for conducting such that movement by said upstanding post about the bed of ash carries ash from the vicinity of said thermocouple.

16. The incinerator apparatus according to claim 10 wherein said control means includes detector means responsive to the hot ash surface of said bed of ash forming the bottom of said combustion chamber, and ash discharge means responsive to said detector means for removing ash from said bed of ash to maintain the bed height within predetermined heights.

17. The incinerator apparatus according to claim 10 wherein said control means includes stirrer means for agitating the ash which forms said combustion chamber bottom.

18. In an incinerator apparatus for waste material wherein waste stored in a ram fed storage chamber is carried and discharged into a high temperature combustion chamber to reduce the waste to ash which collects at a bottom portion of a combustion chamber, the improvement comprising a bar traversing the entrance to the combustion chamber for supporting waste material in the waste storage chamber under a force imposed by the ram feed, and means for controlling the abrading of charred waste by said bar into said combustion chamber, ash discharge control means responsive to the collection of ash at the bottom of the combustion chamber for maintaining a combustion chamber bottom comprised of a bed of ash to form a thermally insulated bottom to the combustion chamber.

19. The incinerator apparatus according to claim 18 wherein said detector means including a member carried by rotatable shaft means pressing upon the upper surface of said bed of ash, said shaft means being rotatable about the principal axis thereof and extending to a bottom portion of said bed of ash, and sensor means responsive to displacements of said shaft means along said axis.

20. The incinerator apparatus according to claim 19 wherein said member carried by rotatable shaft means includes an arm having a ski tip.

21. The incinerator apparatus according to claim 19 wherein said sensor means includes switch means, and switch activation means carried by said shaft means for activating said switch means.

22. An incinerator apparatus for waste material, said apparatus including a waste storage chamber having ram means for feeding waste material to underlying combustion chamber, a bar traversing the entrance to the combustion chamber for supporting waste material in the waste storage chamber under a force imposed by the ram feed, and means for controlling the abrading of charred waste by said bar into said combustion chamber, said combustion chamber having concentrically arranged inner and outer walls forming an inner combustion chamber within said inner wall and an annular outer combustion chamber between said inner and outer walls, said annular outer combustion chamber communicating with said inner combustion chamber and having an exhaust, said annular outer combustion chamber providing sufficient residence time for complete combustion of residual pyrolytic gases and carboneous particulates received from said inner combustion chamber; and control means for maintaining a bed of ash at the bottom of said combustion chambers to thermally insulate the bottom thereof.

23. The incinerator apparatus according to claim 22 further including means for introducing air into each of said inner combustion chamber and said annular outer combustion chamber.

24. The incinerator apparatus according to claim 23 further including means including a thermocouple for controlling said means for introducing air to each of said inner combustion chamber and said annular outer combustion chamber.

25. The incinerator apparatus according to claim 22 further including control means for maintaining a bed of ash at the bottom of said combustion chambers to thermally insulate the bottom thereof.

26. An incinerator apparatus for incinerating waste material, said apparatus comprising:

a vertically extending waste storage container having a central longitudinal waste feed axis;

a combustion chamber situated below said storage container and in communication therewith;

means for compacting waste material loaded into said storage container by applying force to the waste material in the direction of the combustion chamber during incineration of the waste material;

means for densifying ash and maintaining a predetermined ash thickness layer in the bottom of said combustion chamber;

bar means rotatably supported to extend through said combustion chamber substantially transverse to said central longitudinal waste feed axis for supporting a bottom surface of the compacted waste material in the storage chamber and for abrading charred material from said bottom surface;

means causing abrading of charred material by said bar means for automatically controlling the temperature of the combustion chamber relative to a predetermined set point temperature; and means for exhausting combustion gases from said combustion chamber.

27. The apparatus of claim 26 wherein said means for automatically controlling combustion of the waste material further includes means for detecting the temperature within said combustion chamber, and means responsive thereto for controlling a supply of air to the combustion chamber.

28. The apparatus of claim 27 wherein said combustion chamber includes an outer vertical side wall, said apparatus further including means forming an outer annular chamber surrounding said side wall, said side wall having a lower edge penetrating said ash bed.

* * * * *